US006603938B2

(12) United States Patent
Tsubakimoto

(10) Patent No.: US 6,603,938 B2
(45) Date of Patent: Aug. 5, 2003

(54) IMAGE FORMING APPARATUS WITH AIR FLOW INCLINED TO APPARATUS SIDE SURFACE

(75) Inventor: Yasuhito Tsubakimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/938,524

(22) Filed: Aug. 27, 2001

(65) Prior Publication Data

US 2002/0031366 A1 Mar. 14, 2002

(30) Foreign Application Priority Data

Aug. 28, 2000 (JP) ..... 2000-256959

(51) Int. Cl.[7] ..... G03G 21/20

(52) U.S. Cl. ..... 399/92; 347/152; 361/695

(58) Field of Search ..... 399/91, 92, 93, 399/98, 107, 111, 114; 347/138, 152; 361/695, 696; 400/679; 355/30

(56) References Cited

U.S. PATENT DOCUMENTS 6,097,911 A * 8/2000 Watanabe et al. ..... 399/114
6,115,564 A * 9/2000 Morimoto ..... 399/92
6,205,302 B1 * 3/2001 Yokota ..... 399/92

* cited by examiner

*Primary Examiner*—Hoan Tran
(74) *Attorney, Agent, or Firm*—Fitzpatrick, Cella, Harper & Scinto

(57) ABSTRACT

An object of the present invention is to provide an image forming apparatus that has image forming device for forming an image on a moving recording material, and a fan for taking in air from outside to cool the interior of the apparatus, wherein the fan is arranged so as to be inclined with respect to a moving direction of the recording material.

19 Claims, 4 Drawing Sheets

IMAGE FORMING APPARATUS WITH AIR FLOW INCLINED TO APPARATUS SIDE SURFACE

BACKGROUND OF THE INVENTION

1. Field of the Invention

The present invention relates to an image forming apparatus, such as a copying machine or a printer, and, in particular, to an image forming apparatus in which the interior of the main body of the apparatus is cooled by a cooling fan.

2. Related Art

FIG. 6 is a sectional view of a conventional image forming apparatus. In the drawing, symbol P indicates a sheet of paper, numeral 101 indicates an image fixing apparatus, numeral 102 indicates a laser scanner, numeral 103 indicates a sheet discharge outlet, numeral 104 indicates an intake fan, numeral 105 indicates a sheet feeding tray, numeral 106 indicates a sheet feeding roller, numeral 107 indicates a photosensitive drum, numeral 108 indicates a toner cartridge, and numeral 110 indicates a sheet feeding tray.

FIG. 7 is a plan view of the image forming apparatus shown in FIG. 6. In the drawing, numeral 109 indicates an air outlet. The other components are indicated by the same reference numerals as those in FIG. 6.

Next, the operation of this image forming apparatus, constructed as described above, will be illustrated.

When a printing command from a host computer (not shown) is received, the sheet P is fed by the sheet feeding roller 106. At the same time, a latent image formed on the photosensitive drum 107 by the laser scanner 102 and borne on the photosensitive drum is developed in the toner cartridge 108 and visualized as a toner image. Then, the toner image is transferred to the sheet P. The toner image thus transferred is fixed to the sheet P by the image fixing apparatus 101, and then the sheet P is discharged from the sheet discharge outlet 103.

It is to be noted that heat is generated from the image fixing apparatus 101, the laser scanner 102, etc., and this heat causes a temperature rise in various portions of the main body. In view of this, air is taken in from the exterior of the apparatus by the intake fan 104, and the interior of the apparatus is cooled by this air. The air that has been warmed as a result of the cooling is discharged from the air outlet 109, whereby the temperature of the various portions of the apparatus is kept at a level not higher than a constant value.

However, in the above conventional image forming apparatus, in which a cooling fan is mounted to a side of the apparatus main body, the cooling of the apparatus is effected from the width direction that is perpendicular to the direction in which the sheet is conveyed. As a result, the apparatus to be cooled involves generation of a difference in temperature in the width direction.

When a plurality of apparatuses are to be cooled, it is necessary to distribute the air by, for example, providing a plurality of cooling fans or providing a duct.

Further, when the air that has cooled the image fixing apparatus is discharged through, for example, a side portion of the apparatus main body, steam which has been generated from the sheet heated by the image fixing apparatus is also discharged, with the result that the sheet conveyance passage from the image fixing apparatus onward is dried, thereby causing the sheet to be curled.

SUMMARY OF THE INVENTION

It is an object of the present invention to provide an image forming apparatus which allows a plurality of apparatuses to be cooled uniformly in the width direction without having to use any special member.

Another object of the present invention is to provide an image forming apparatus which has an image forming means for forming an image on a moving recording material and a fan for taking in air from the exterior of the apparatus to cool the interior thereof, wherein the fan is arranged so as to be inclined with respect to the direction in which the recording material moves.

Further objects of the present invention will become apparent from the following description.

DETAILED DESCRIPTION OF THE PREFERRED EMBODIMENTS

Embodiments of the present invention will now be described with reference to the accompanying drawings.

Embodiment 1

Figure 1:
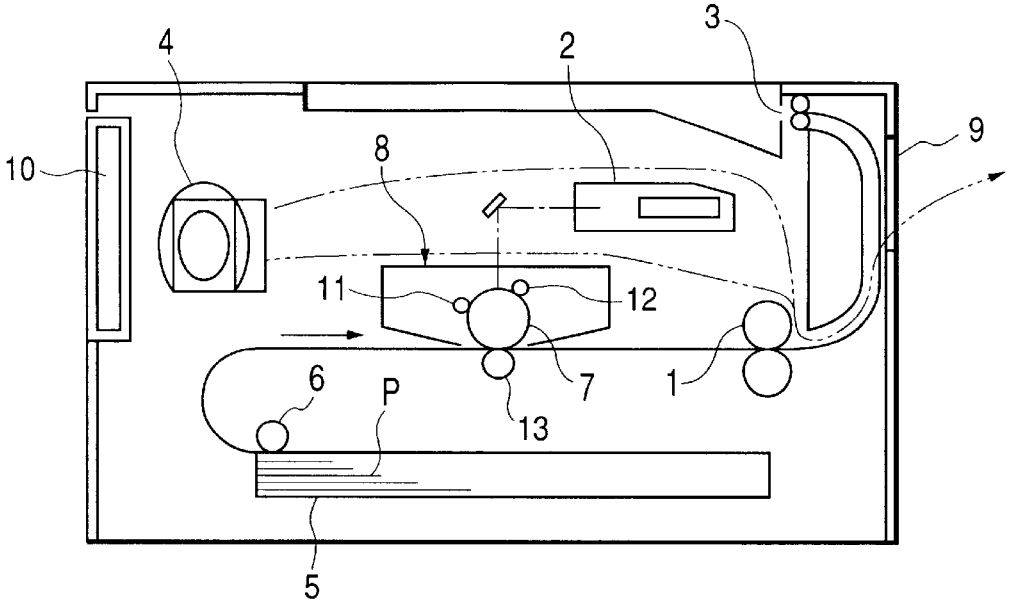
FIG. 1 is a sectional view of an image forming apparatus in accordance with Embodiment 1 of the present invention.
Figure 2:
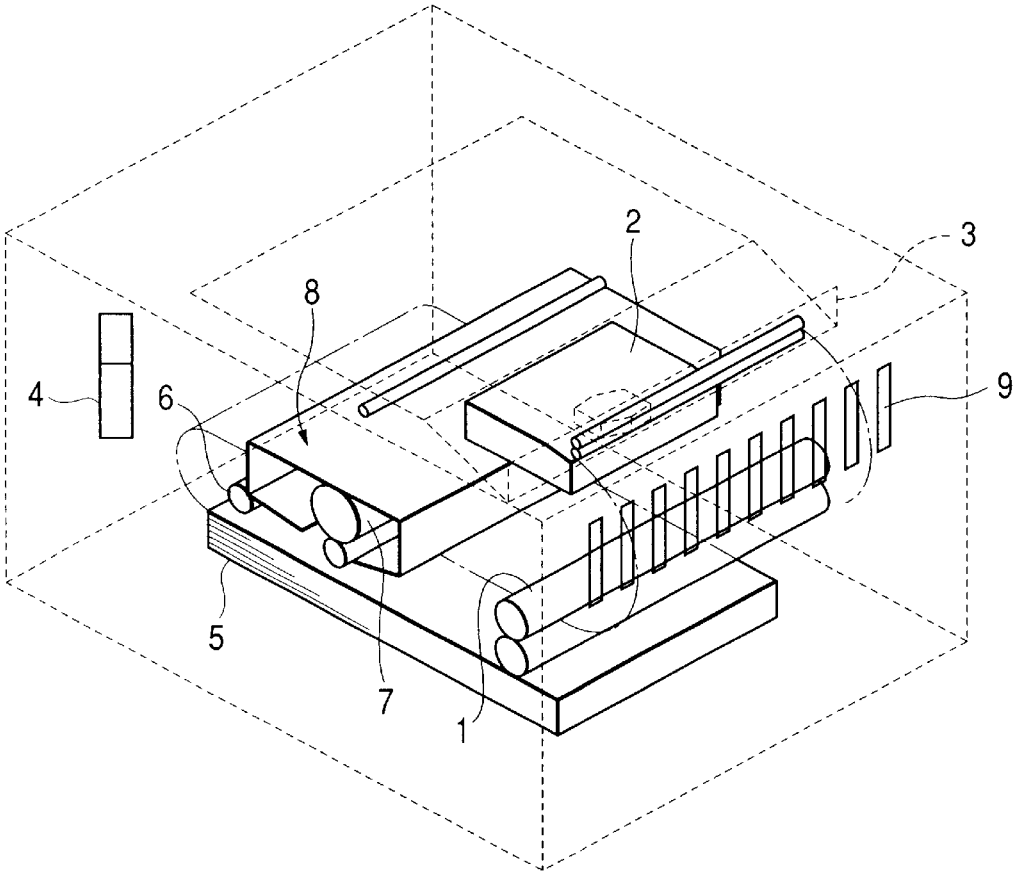
FIG. 2 is a perspective view of the image forming apparatus in accordance with Embodiment 1 of the present invention.
Figure 3:
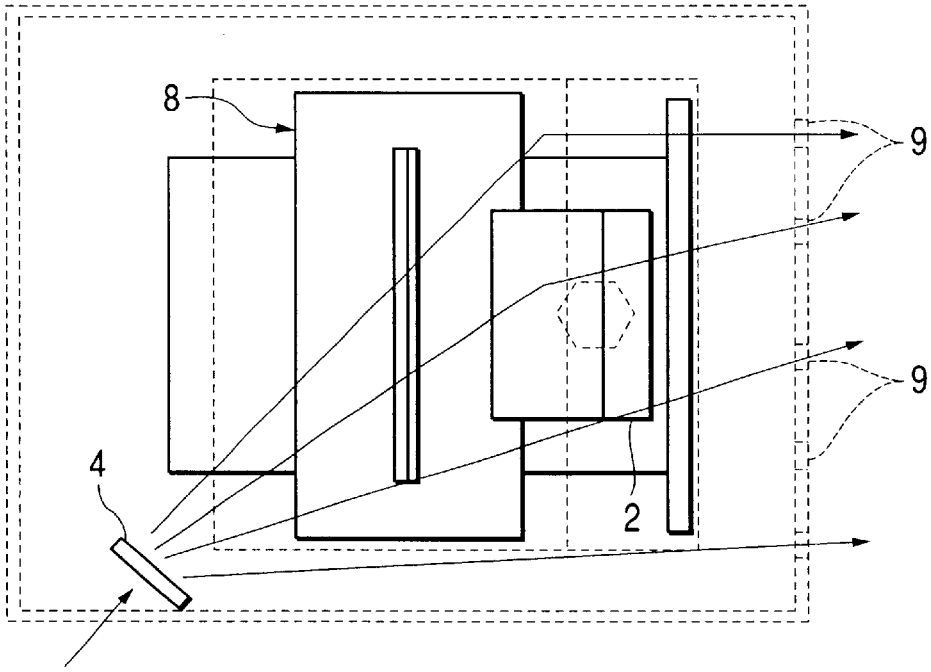
FIG. 3 is a plan view of the image forming apparatus in accordance with Embodiment 1 of the present invention.

FIG. 1 is a sectional view of an image forming apparatus according to the present invention, FIG. 2 is a perspective view of the image forming apparatus, and FIG. 3 is a plan view of the image forming apparatus. In these drawings, numeral 1 indicates an image fixing apparatus, numeral 2 indicates a laser scanner, numeral 3 indicates a sheet discharge outlet, numeral 4 indicates an intake fan (cooling fan) situated above the fixing apparatus 1 and adapted to take in air from outside to cool the interior of the apparatus, numeral 5 indicates a sheet feeding tray, numeral 6 indicates a sheet feeding roller, numeral 7 indicates a photosensitive drum serving as an image bearing member, numeral 8 indicates a process cartridge (toner cartridge) detachably attachable to the main body of the apparatus and accommodating the image bearing member and at least one image forming means, numeral 9 indicates an air outlet provided in the sheet discharging passage, and numeral 10 indicates a manual sheet feeding tray. The process cartridge contains the photosensitive drum 7, a charging roller 12 serving as a charging means, a developing roller 11 serving as a developing means, toner, etc.

In the image forming apparatus of this embodiment, when a printing command from a host computer (not shown) is received, the sheet P serving as the recording material is fed by the sheet feeding roller 6, and a latent image formed on the photosensitive drum 7 by the laser scanner 2 and borne by the photosensitive drum is developed as a toner image in the process cartridge 8, the toner image being transferred to the sheet P by a transferring roller 13. Then, the toner image which has been transferred to the sheet P is heated and pressurized by the fixing apparatus 1 and fixed to the sheet P. The sheet P to which the toner image has been fixed is discharged from the sheet discharge outlet 3.

It is to be noted that heat is generated from the fixing apparatus 1, the laser scanner 2, etc. To ensure the desired toner quality, it is desirable for the temperature of the process cartridge 8, which is free from heat generation, to be not higher than a constant value even under the influence of the heat generation sources.

As shown in FIG. 3, in this embodiment, the intake fan 4 is arranged on the upstream side of the fixing apparatus 1, the laser scanner 2, and the process cartridge 8 with respect to the sheet conveying direction so as to be inclined with respect to a side surface of the conveyance passage (a side surface of the main body of the apparatus), that is, inclined with respect to the sheet moving direction.

Here, when it is said that "the fan is inclined", it means that the axis of the fan is inclined with respect to a direction perpendicular to the direction in which the recording material moves. In other words, the direction of the main current of air due to the fan is inclined with respect to a direction perpendicular to the moving direction of the recording material.

Due to this arrangement, in this embodiment, the air taken in from the outside of the apparatus by the intake fan 4 cools the process cartridge 8, the laser scanner 2, and the fixing apparatus 1, sequentially in that order, that is, it cools a plurality of devices in ascending temperature order.

Then, since the intake fan 4 is mounted so as to be inclined with respect to the side surface of the conveyance passage, it can directly supply outside air in the sheet conveyance width direction (the direction perpendicular to the moving direction of the sheet). That is, it is possible to supply air not only from the direction perpendicular to the moving direction of the sheet, but also from a direction close to the sheet moving direction, whereby it is possible to cool the fixing apparatus, the laser scanner, the process cartridge, etc. uniformly over the entire area extending in the sheet conveyance width direction.

Further, since the air caused to flow by the intake fan 4 is directed toward the downstream side with respect to the sheet moving direction, the air from the intake fan 4 can be efficiently deflected in the sheet moving direction, thereby achieving an improvement in cooling efficiency.

The intake fan 4 is an axial-flow fan. The orientation of its blades, its rotating direction, and the current of air in this fan are shown in FIG. 4, which is a perspective view of the fan.

Figure 4:
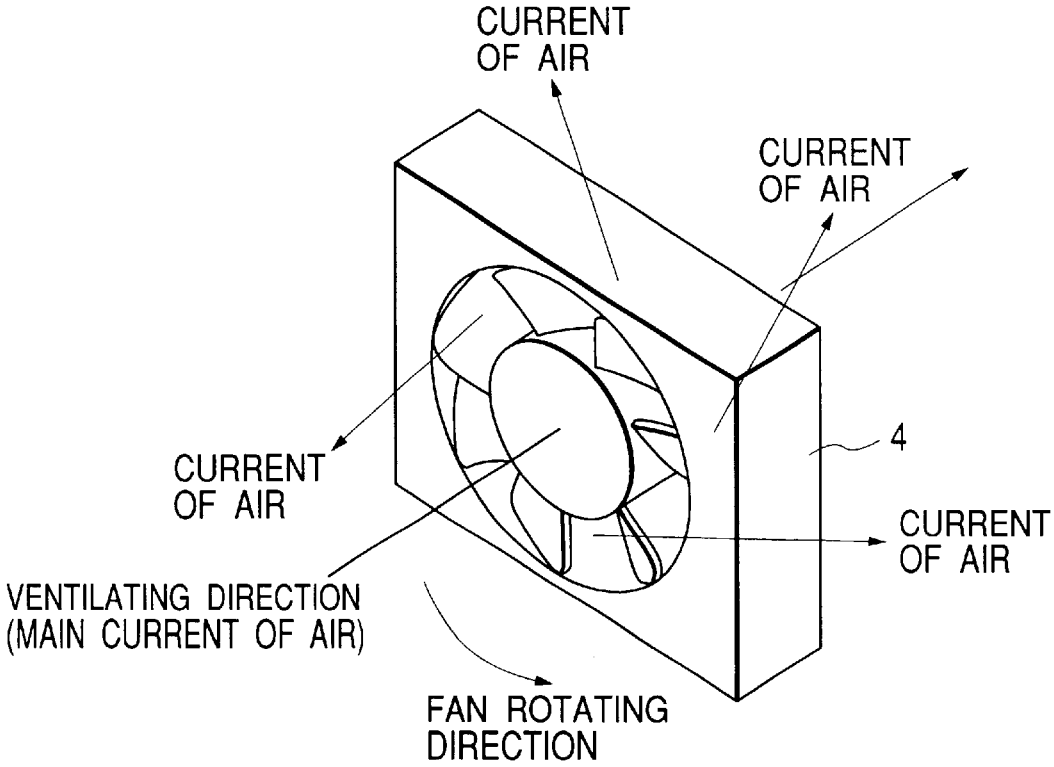
FIG. 4 is a perspective view of a cooling fan provided in the image forming apparatus in accordance with Embodiment 1 of the present invention.

As shown in FIG. 4, in the intake fan 4 consisting of an axial-flow fan, a current of air is generated in a direction which is a synthesis of the axial direction and the rotation locus direction. Thus, as shown in FIG. 4, on the outlet side of the fan 4, which rotates counterclockwise as seen from the intake side, there is generated a current of air diverging counterclockwise. When, in this condition, air strikes a surface inside the apparatus, the air is deflected with respect to the axial direction.

When, as shown in FIG. 1, the intake fan 4 rotating counterclockwise is arranged on the right-hand side of the apparatus main body as seen from the upstream side with respect to the recording material conveying direction (i.e., on the lower side in FIG. 3) so as to be above the fixing apparatus 1, air strikes the sheet conveyance surface to thereby generate below the intake fan 4*a* current of air deflected to the right-hand side in the axial direction as shown in FIG. 3, thereby directly cooling all portions of the fixing apparatus 1 along the direction of its width.

That is, the air is rotated by the fan as it advances. However, at the portion contacting with the recording material, the air caused to flow by the fan is directed to the direction that is forward to the moving direction of the recording material.

The steam generated from the sheet P in the fixing apparatus 1 travels by way of the conveyance passage and is discharged from the air outlet 9 together with the air.

Due to the above arrangement, in this embodiment, it is possible to effect-cooling so as to achieve a uniform temperature distribution along the width direction while cooling a plurality of apparatuses by a single intake fan 4.

Further, by causing the steam generated in the fixing apparatus 1 to flow by way of the conveyance passage on the downstream side of the fixing apparatus 1 with respect to the sheet conveying direction, it is possible to increase the humidity of the conveyance passage on the downstream side with respect to the sheet conveying direction, so that it is possible to restrain the drying of the sheet P in the conveyance passage after the fixing of the image, thereby making it possible to restrain the curling of the sheet P.

When, conversely to this embodiment, the cooling fan 4 is arranged on the left-hand side, an intake fan is adopted which rotates clockwise as seen from the intake side.

Embodiment 2

Figure 5:
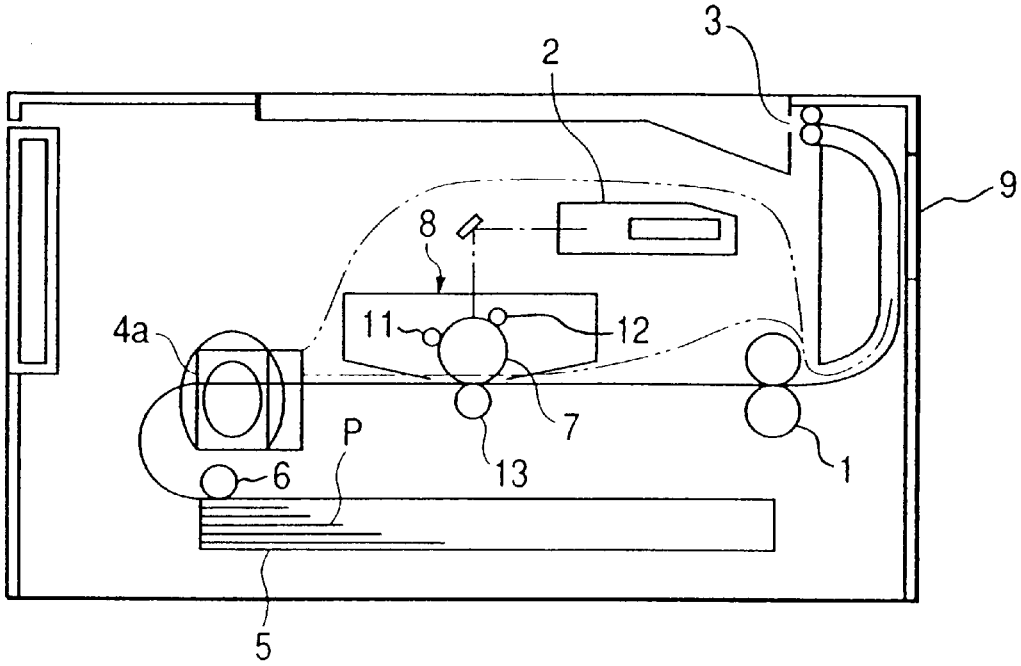
FIG. 5 is a sectional view of an image forming apparatus in accordance with Embodiment 2 of the present invention.
Figure 6:
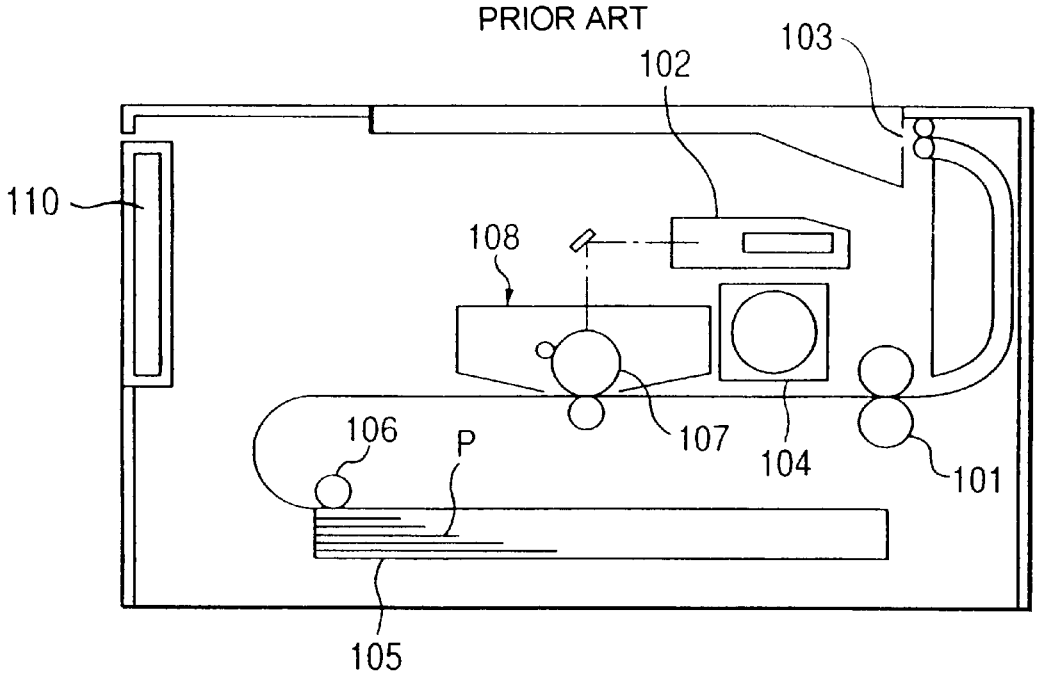
FIG. 6 PRIOR ART
FIG. 6 is a sectional view of a conventional image forming apparatus.
Figure 7:
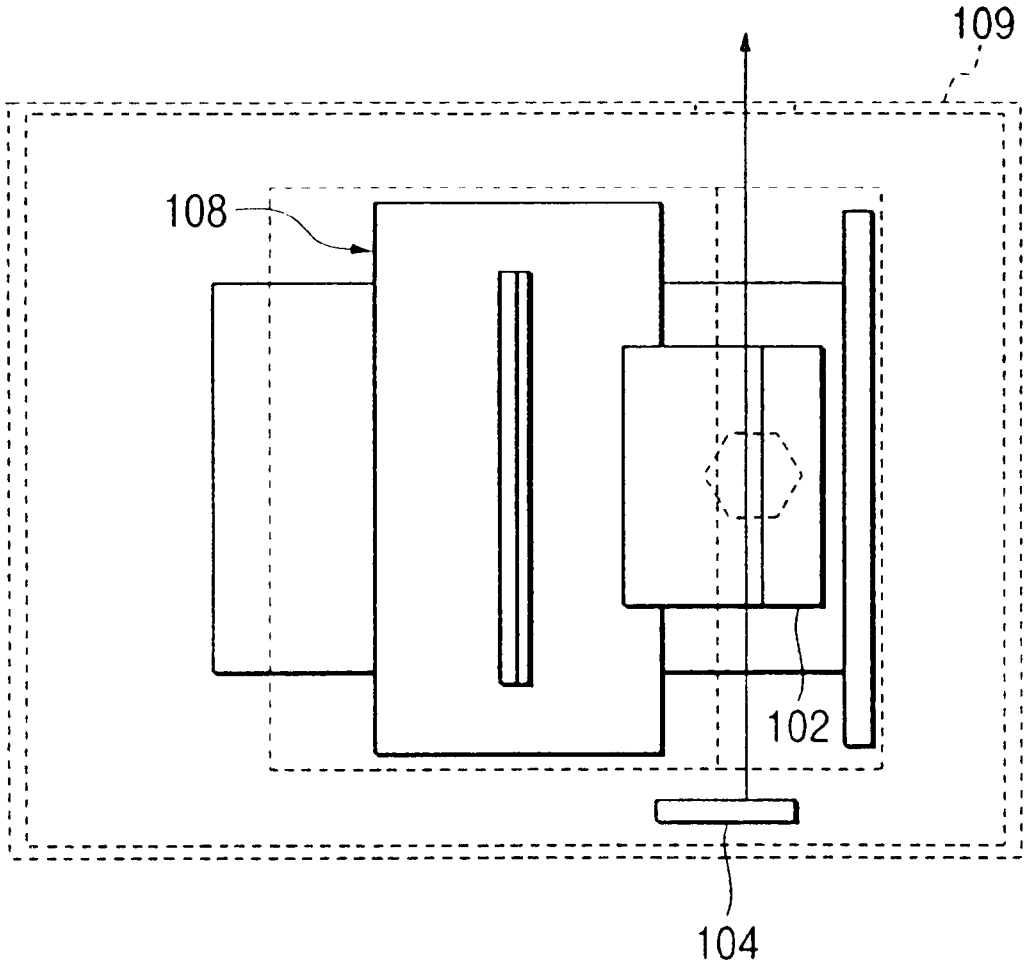
FIG. 7 PRIOR ART
FIG. 7 is a plan view of the conventional image forming apparatus.

Next, Embodiment 2 of the present invention will be described with reference to FIG. 5. FIG. 5 is a sectional view of an image forming apparatus according to Embodiment 2 of the present invention. In the drawing, the components which are the same as those of FIG. 1 are indicated by the same reference symbols, and a description thereof will be omitted.

In FIG. 5, reference symbol 4*a* indicates an intake fan (cooling fan) situated below the image fixing apparatus 1. In the image forming apparatus of this embodiment, the image forming operation is conducted in the same manner as in Embodiment 1.

It is to be noted that, in this embodiment, the intake fan 4*a* is arranged below the image fixing apparatus 1, so that a fan which rotates clockwise as seen from the intake side is adopted as the intake fan 4*a*. Thus, as in the case of Embodiment 1, it is possible to effect cooling so as to achieve a uniform temperature distribution along the width direction while cooling a plurality of apparatuses by a single cooling fan 4*a*.

Further, by causing the steam generated in the fixing apparatus 1 to flow by way of the conveyance passage on the downstream side of the fixing apparatus 1 with respect to the sheet conveying direction, it is possible to increase the humidity of the conveyance passage on the downstream side with respect to the sheet conveying direction, so that it is possible to restrain the drying of the sheet P in the conveyance passage after the fixing of the image, thereby making it possible to restrain the curling of the sheet P.

When, conversely to this embodiment, the intake fan 4 is arranged on the left-hand side, a fan is adopted which rotates counterclockwise as seen from the intake side.

As is apparent from the above description, in accordance with the present invention, there is provided an image forming apparatus in which a plurality of units in the apparatus main body are cooled by outside air introduced into the apparatus main body by an intake fan arranged on a side of a sheet conveyance passage inside the apparatus main body, in which the intake fan is arranged so as to be inclined with respect to a side surface of the apparatus main body, that is, with respect to the sheet conveying direction, and in which the air from the intake fan is directed to the downstream side with respect to the sheet conveying direction, whereby it is possible to cool a plurality of apparatuses uniformly along the width direction without having to use any special member.

The above-described embodiments of the present invention should not be construed restrictively. All manner of modifications are possible without departing from the scope of the present invention.

What is claimed is:

1. An image forming apparatus comprising:

image forming means for forming an image on a moving recording material; and a fan for taking in air from outside to cool an interior of said apparatus, wherein a direction of a main air flow caused by said fan is inclined with respect to a side surface of a main body of the image forming apparatus, the side surface being parallel to a moving direction of the recording material.

2. An image forming apparatus according to claim 1, wherein said fan is an axial -flow fan, and wherein an axis of said fan is inclined with respect to a direction of the side surface of the main body of the image forming apparatus.

3. An image forming apparatus according to claim 2, wherein a direction of an air intake surface and an air outlet surface of said fan of the main body of the air outlet surface of said fan of the main body of the image forming apparatus is inclined with respect to the side surface direction.

4. An image forming apparatus according to claim 1, wherein said fan is arranged near either side surface fo both side surfaces of the main body of the image forming apparatus, said both side surfaces being parallel to a moving direction of the recording material.

5. An image forming apparatus according to claim 1, wherein the air is directed to a downstream side with respect to the moving direction of the recording material by said fan.

6. An image forming apparatus according to claim 1, wherein said image forming means has a laser scanner, and wherein said fan is provided on an upstream side of said laser scanner with respect to the moving direction of the recording material.

7. An image forming apparatus according to claim 1, wherein said image forming means has fixing means, and wherein said fan is provided on an upstream side of said fixing means with respect to the moving direction of the recording material.

8. An image forming apparatus according to claim 1, further comprising a process cartridge which is detachably attachable to the main body of said apparatus and which contains an image bearing member and at least one image forming means, wherein said fan is provided on an upstream side of said process cartridge with respect to the moving direction of the recording material.

9. An image forming apparatus according to claim 1, wherein said image forming means has fixing means, and wherein the air is discharged by said fan to an exterior of said apparatus through a conveyance passage provided on a downstream side of said fixing means with respect to the moving direction of the recording material.

10. An image forming apparatus according to claim 1, wherein, at a portion contacting with the recording material, a flow of the air caused by the fan is directed to a direction forward to the moving direction of the recording material.

11. An image forming apparatus comprising:

image forming means for forming an image on a moving recording material; and a fan for taking in air from outside to cool an interior of said apparatus, wherein said fan is an axial-flow fan, and wherein an axis of said fan is inclined with respect to a side surface of a main body of the image forming apparatus, the side surface being parallel to a moving direction of the recording material.

12. An image forming apparatus according to claim 11, wherein a direction of an air intake surface and an air outlet surface of said fan of the main body of the image forming apparatus is inclined with respect to the side surface.

13. An image forming apparatus according to claim 11, wherein said fan is arranged near either side surface of both side surfaces of the main body of the image forming apparatus, said both side surfaces being parallel to the moving direction of the recording material.

14. An image forming apparatus according to claim 11, wherein the air is directed to a downstream side with respect to the moving direction of the recording material by said fan.

15. An image forming apparatus according to claim 11, wherein said image forming means has a laser scanner, and wherein said fan is provided on an upstream side of said laser scanner with respect to the moving direction of the recording material.

16. An image forming apparatus according to claim 11, wherein said image forming means has fixing means, and wherein said fan is provided on an upstream side of said fixing means with respect to the moving direction of the recording material.

17. An image forming apparatus according to claim 11, further comprising a process cartridge which is detachably attachable to the main body of said apparatus and which contains an image bearing member and at least one image forming means, wherein said fan is provided on an upstream side of said process cartridge with respect to the moving direction of the recording material.

18. An image forming apparatus according to claim 11, wherein said image forming means has fixing means, and wherein the air is discharged by said fan to an exterior of said apparatus through a conveyance passage provided on a downstream side of said fixing means with respect to the moving direction of the recording material.

19. An image forming apparatus according to claim 11, wherein, at a portion contacting with the recording material, a flow of the air caused by the fan is directed to a direction forward to the moving direction of the recording material.

* * * * *

UNITED STATES PATENT AND TRADEMARK OFFICE

CERTIFICATE OF CORRECTION

PATENT NO. : 6,603,938 B2
DATED : August 5, 2003
INVENTOR(S) : Yasuhito Tsubakimoto It is certified that error appears in the above-identified patent and that said Letters Patent is hereby corrected as shown below:

Column 4,
Line 2, “4a” should read -- 4 a --.
Line 15, “effect-cooling” should read -- effect cooling --.

Column 5,
Line 28, “axial -flow” should read -- axial-flow --.
Line 33, “air outlet surface” should be deleted.
Line 34, “of said fan of the main body of the” should be deleted.
Line 37, “fo” should read -- of --.

Signed and Sealed this

Twentieth Day of January, 2004

JON W. DUDAS
*Acting Director of the United States Patent and Trademark Office*